US007845339B2

(12) United States Patent
Cecil et al.

(10) Patent No.: US 7,845,339 B2
(45) Date of Patent: Dec. 7, 2010

(54) EXHAUST GAS RECIRCULATION COOLER COOLANT PLUMBING CONFIGURATION

(75) Inventors: Adam C. Cecil, Columbus, IN (US); Kristopher R. Bare, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 33 days.

(21) Appl. No.: 12/335,764

(22) Filed: Dec. 16, 2008

(65) Prior Publication Data

US 2010/0147272 A1 Jun. 17, 2010

(51) Int. Cl.
*F02B 47/08* (2006.01)
*F02B 47/00* (2006.01)

(52) U.S. Cl. ..... 123/568.12

(58) Field of Classification Search ..... 123/568.12, 123/568.11, 41.05, 41.08, 41.31, 41.29, 44.44, 123/41.09, 196 AB; 701/108; 60/605.2, 60/278, 298

See application file for complete search history.

(56) References Cited

U.S. PATENT DOCUMENTS 5,732,688 A 3/1998 Charlton et al.
6,237,547 B1 5/2001 Ishiyama
6,244,256 B1 6/2001 Wall et al.
7,299,771 B2 * 11/2007 Wei et al. ..... 123/41.08
2006/0157002 A1 * 7/2006 Pfeffinger et al. ..... 123/41.29
2006/0213459 A1 * 9/2006 Theorell ..... 123/41.02
2007/0157893 A1 * 7/2007 Wei et al. ..... 123/41.08
2008/0271721 A1 * 11/2008 Wikstrom ..... 123/568.12

* cited by examiner

*Primary Examiner*—Mahmoud Gimie
(74) *Attorney, Agent, or Firm*—Studebaker & Brackett PC; Tim L. Brackkett, Jr.; J. Bruce Schelkopf

(57) ABSTRACT

A cooling system for an engine is disclosed. In a first embodiment, the cooling system may comprise a heat exchanger, a pump coupled to the heat exchanger, an EGR cooler coupled to the pump, and a first valve coupled to the EGR cooler and the heat exchanger. When the first valve is in a first position, the first valve directs a coolant to the heat exchanger and when the first valve is in a second position, the heat exchanger is bypassed and coolant flows directly to the pump. It is an advantage for a cooling system to utilize a valve to maximize the rate a coolant flows throughout the system when the valve is in an open position and also to warm up an engine when the valve is in a closed position.

17 Claims, 3 Drawing Sheets

EXHAUST GAS RECIRCULATION COOLER COOLANT PLUMBING CONFIGURATION

FIELD OF THE INVENTION

The present invention relates generally to engine systems and more specifically to an engine cooling system.

BACKGROUND OF THE INVENTION

It is generally known that the combustion process within an engine produces noxious oxides of nitrogen ($NO_x$), which causes undesirable results, such as pollution. The presence of $NO_x$ in the exhaust gas of internal combustion engines is generally understood to depend upon the temperature of combustion within the combustion chamber of an engine. To control the emissions of unwanted exhaust gas constituents from internal combustion engines, it is known to re-circulate a portion of the exhaust gas back to an air intake portion of the engine. Because the re-circulated exhaust gas effectively reduces the oxygen concentration of the combustion air, the flame temperature at combustion is correspondingly reduced, which decreases the emissions of $NO_x$ since the $NO_x$ production rate is exponentially related to flame temperature.

It is further known to cool the re-circulated exhaust gas prior to introducing the gas at the engine air intake port. Thus, an EGR cooler is typically arranged within the exhaust gas recirculation system to cool the stream of re-circulated exhaust gas. The temperature of the exhaust gas exiting from the cooler is critical both to the $NO_x$ control process and to the integrity of the cooler and the downstream components, such as EGR conduits, EGR flow control valves, and the engine.

However, next generation emission standards will require lower intake manifold temperatures. In order to meet these standards, a new approach to EGR-cooler-coolant plumbing is needed. The present invention addresses such a need.

BRIEF SUMMARY

A cooling system for an engine is disclosed. In a first embodiment, the cooling system may comprise a heat exchanger, a pump coupled to the heat exchanger, an EGR cooler coupled to the pump, and a first valve coupled to the EGR cooler and the heat exchanger. When the first valve is in a first position, the first valve directs a coolant to the heat exchanger and when the first valve is in a second position, the heat exchanger is bypassed and coolant flows directly to the pump.

Through the use of the above described system the rate that coolant flows throughout the system is maximized when the valve is in an open position and engine can warm up in an efficient manner when the valve is in a closed position.

BRIEF DESCRIPTION OF SEVERAL VIEWS OF THE DRAWINGS

The present embodiment is illustrated by way of example and not limitation in the figures of the accompanying drawings, in while like references indicate similar elements, and in which:

FIG. 3 is an illustration of the first valve as a temperature controlled device.

DETAILED DESCRIPTION OF THE INVENTION

The present invention relates generally to engines and more specifically to an engine cooling system. The following description is presented to enable one having ordinary skill in the art to make and use the embodiment and is provided in the context of a patent application and the generic principles and features described herein will be apparent to those skilled in the art. Thus, the present embodiment is not intended to be limited to the embodiments shown, but is to be accorded the widest scope consistent with the principles and features described herein.

A cooling system is disclosed for engines that meet the requirements of next generation emissions standards. The system utilizes exhaust gas recirculation (EGR) cooler plumbing and reduced EGR cooler inlet temperatures, while minimizing a coolant flow-rate decrease through a cylinder head and cylinder block of the engine.

Figure 1:
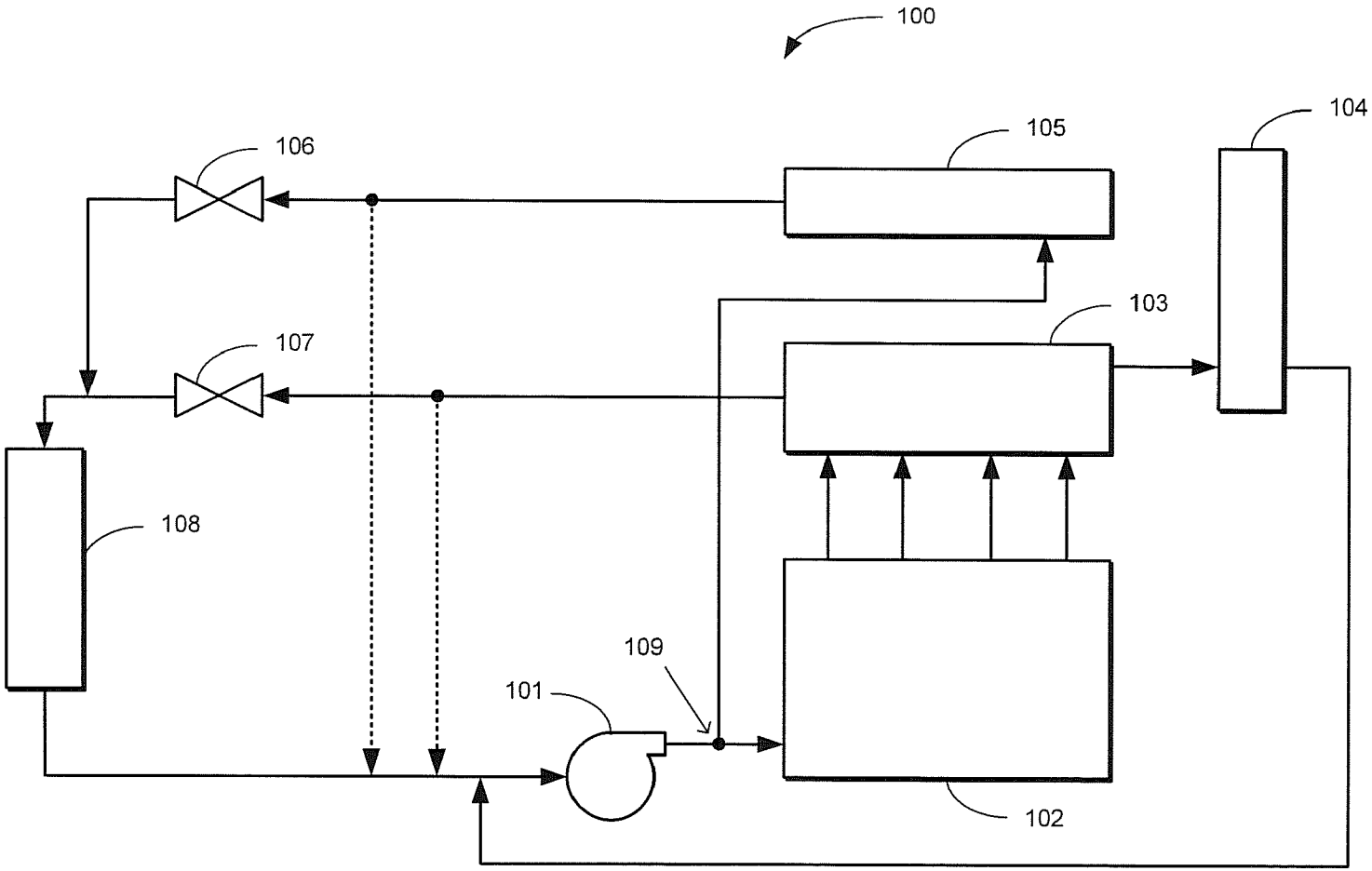
FIG. 1 is a perspective view of a cooling system for an engine, according to an embodiment.

FIG. 1 shows a cooling system 100 for use with an engine or engine system. As shown, the cooling system 100 includes a cooling loop which includes a heat exchanger 108 coupled to a pump 101 and a cylinder block 102 component of an engine 120 coupled to the pump 101. The heat exchanger 108 and the pump 101 can be a variety of types. For example, the heat exchanger 108 may be a radiator, a skin cooler, a keel cooler and the like and its use would be within the spirit and scope of the present invention. The pump may be a water pump, coolant pump, or the like.

Furthermore, the cooling loop also features the pump 101 coupled to an EGR cooler 105 within the cooling system. That is, pump 101 may have a dual outlet 109 to direct a coolant to both the cylinder block 102 and the EGR cooler 105. The cooling system 100 also comprises a valve 106 which is coupled to the EGR cooler 105 and the heat exchanger 108. For an embodiment, the valve 106 is coupled to the outlet of the EGR cooler 105 and the inlet of the heat exchanger 108.

Figure 2:
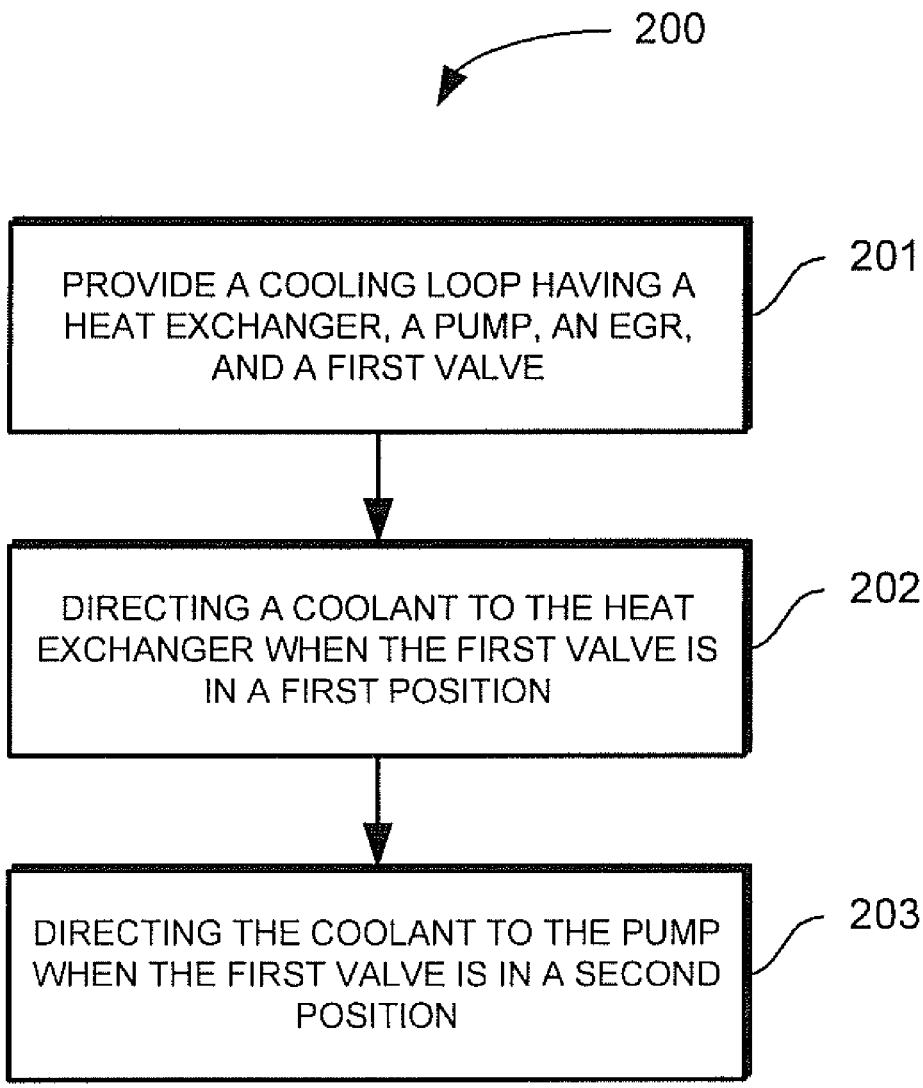
FIG. 2 is a flow chart of a method for cooling an engine, according to an embodiment.

A method and system in accordance with the present invention is shown by the flowchart in FIG. 2, which discloses a method for cooling an engine system. As shown in step 201, a cooling loop having a heat exchanger 108, a pump 101, an EGR cooler 105, and a first valve 106 is provided. Next, according to step 202, a coolant is directed to the heat exchanger 108 when the first valve 106 is in a first position. Then, the coolant is directed to the pump 101 when the first valve 106 is in a second position, according to a step 203.

The pump 101 may be coupled to the cylinder block 102 and the EGR cooler 105 through conduits, channels, pipes, inlets, outlets, and any other suitable connections known in the art. For an embodiment, the pump 101 is coupled to the cylinder block 102 and the EGR cooler 105 through pipes embedded within the cooling system 100 such that a coolant flows from the pump 101 to the cylinder block 102 and from the pump 101 to the EGR cooler 105, as shown in FIG. 1.

Within cooling system 100, the valve 106 regulates the flow of coolant from the EGR cooler 105. The valve 106 directs the coolant according to the position of the valve 106. Accordingly, the valve 106 may take on multiple positions within the cooling system 100 such as, but not limited to, an open-valve position or a closed-valve position. For example, when valve 106 is in an open-valve position, valve 106 directs the coolant to the heat exchanger 108, as shown in FIG. 1.

Alternatively for the embodiment, valve 106 directs the coolant to the pump 101 when valve 106 is in a closed-valve position.

Figure 3:
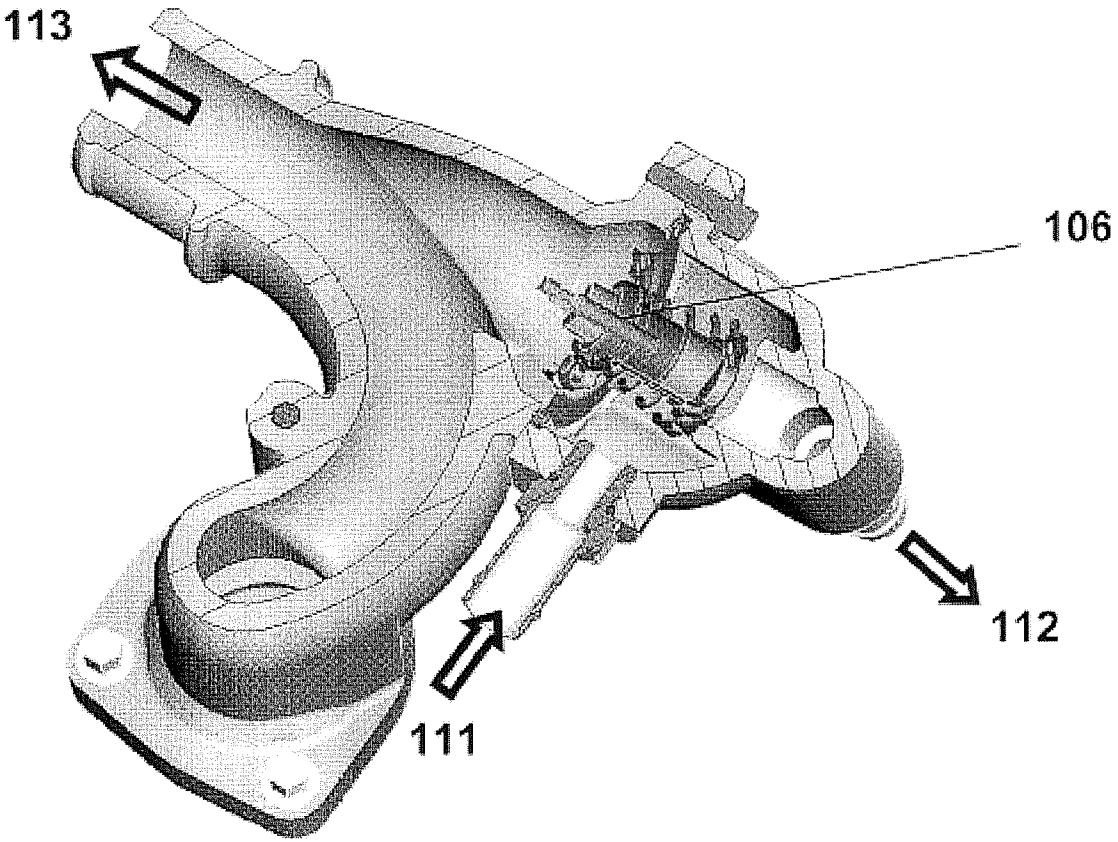
FIG. 3 is a chart that displays flow-rate data for an engine that utilizes a cooling system of the present invention and flow-rate data for engines that use standard cooling systems.

Valve 106 may have various configurations such as the valve shown in FIG. 3. As shown, coolant flows from an EGR cooler to valve 106 along a path 111 where the coolant is directed to a heat exchanger along path 113 or bypasses the heat exchanger and flows to directly to a pump along path 112. Valve 106 may be configured to take on a position based upon a thermal, electrical, or mechanical stimulant. That is, valve 106 may open or close upon thermal, electrical, or mechanical actuation.

For an embodiment when valve 106 is a thermally-controlled valve, valve 106 opens upon when the coolant temperature is greater than a pre-set threshold temperature. As such, valve 106 may comprise a thermostat that measures the temperature of the coolant from the EGR cooler 105 and takes on a position based upon the temperature of the coolant relative to the threshold temperature. For example, when the threshold temperature is 190° F., the valve 106 opens and directs the coolant to the heat exchanger 108 when the coolant temperature has exceeded the threshold temperature. Alternatively for the embodiment, the valve 106 remains closed when the coolant temperature is below the threshold temperature of 190° F. The valve 106 may take on pre-set default positions such as, but not limited to, normally open or normally-closed valve positions. For example, when valve 106 is normally open, coolant flows continuously from the EGR cooler 105 to the heat exchanger unless the coolant temperature is less than the pre-set threshold temperature. For an embodiment, however, valve 106 is normally closed and therefore directs coolant from the EGR cooler 105 to the pump 101 when the coolant temperature exceeds the threshold temperature.

Accordingly, the valve 106 may operate as a control valve within the cooling system 100 and may be used to engage various system functions. For example, when valve 106 is fully closed, the cooling system 100 can allow the engine 120 to warm up more quickly than when valve 106 is open. It is known that while the engine is running, heat will be transferred to components, parts, and fluids in proximity to the engine 120. That is, by closing the valve 106, the coolant will increase in temperature as heat transfers from the engine and will re-circulate through the system 100 without passing through the heat exchanger 108. As such, when valve 106 is closed the cooling system 100 institutes a bypass system to prohibit the coolant from flowing through the heat exchanger 108.

Additionally, the valve 106 may be used to maximize the flow rate of coolant within the cooling system 100. Accordingly, valve 106 is fully open and directs the coolant from the EGR cooler 105 to the heat exchanger 108 to be cooled prior to entry into an inlet of pump 101. Additionally, the pump 101 may comprise a dual outlet to split the coolant into first and second portions of coolant. The first portion of coolant is directed to the cylinder block 102 and the remaining portion of coolant is directed to the EGR cooler 105. Thus, by splitting the coolant, a large pressure differential occurs in the EGR cooler 105, which maximizes overall the flow rate of coolant throughout the cooling system 100. For an embodiment, however, valve 106 is normally closed and therefore directs coolant from the EGR cooler 105 to the pump 101 until the coolant temperature exceeds the threshold temperature.

The cooling system 100 may also comprise additional components such as a second valve 107 and auxiliary devices 104, as shown in FIG. 1. As shown in FIG. 1, the second valve 107 may regulate the coolant from the cylinder head 103. For an embodiment, the valve 107 may operate and be configured similarly to valve 106. That is, valve 107 may also direct the coolant to flow to the heat exchanger 108 when the valve 107 is open and may direct the coolant to bypass the heat exchanger 108 directly to pump 101 when valve 107 is closed. Accordingly, valve 107 opens the coolant temperature exceeds a pre-set threshold temperature and alternatively valve 107 closes when the coolant temperature is lower than the threshold temperature. The threshold temperature for 107 may or may not be the same as that of valve 106. As such, valve 107 may be used to warm up engine 120 quickly when closed or may alternatively be used to maximize the coolant flow rate within the cooling system 100. Valves 106 and 107 can be configured to actuate simultaneously or independently of each other. Additionally, the cooling system 100 may send coolant to the auxiliary devices 104 from cylinder head 102, as shown in FIG. 1. Once the coolant flows throughout the auxiliary devices 104, the coolant flows back to the pump 101.

FIG. 2 shows a method for cooling an engine system according to flowchart 200. As shown in block 201, a cooling loop having a heat exchanger, a pump, an EGR, and a first valve is provided. Next, according to block 202, a coolant is directed to the heat exchanger when the first valve is in a first position. Then, the coolant is directed to the pump when the first valve is in a second position, according to a block 203. Thus, by splitting the coolant, a large pressure differential occurs in the EGR cooler 105, which maximizes the overall flow rate of coolant throughout the cooling system 100.

Although the present embodiment has been described in accordance with the embodiments shown, one having ordinary skill in the art will readily recognize that there could be variations to the embodiments and those variations would be within the spirit and scope of the present embodiment. Accordingly, many modifications may be made by one having ordinary skill in the art without departing from the spirit and scope of the appended claims.

The invention claimed is:

1. A cooling system for use with an engine having a cylinder head, the cooling system comprising:

a heat exchanger;

a pump coupled to the heat exchanger;

an exhaust gas recirculation (EGR) cooler coupled to the pump; [and]

a first valve between the EGR cooler and the heat exchanger wherein when the first valve is in a first position, the first valve directs a coolant to the heat exchanger and when the first valve is in a second position, the heat exchanger is bypassed and coolant flows directly to the pump; and a second valve coupled to the cylinder head and the heat exchanger, wherein when the second valve is in a third position, the second valve directs a coolant to the heat exchanger and when the second valve is in a fourth position, the heat exchanger is bypassed and coolant flows directly to the pump, wherein when the first valve is in the first position, the first valve directs a coolant downstream of said second valve.

2. The cooling system of claim 1, wherein the first position allows the maximum coolant flow rate throughout the cooling system and the second position promotes engine warm up.

3. The cooling system of claim 1 wherein the engine comprises a cylinder head and a cylinder block.

4. The cooling system of claim 3 wherein the first valve is in the first position when the coolant has a temperature greater than a first threshold temperature and the second valve is in the third position when the coolant has a temperature greater than a second threshold temperature, otherwise the first valve and the second valve remains in the second and fourth positions respectively.

5. The cooling system of claim 4, wherein the first threshold temperature is approximately 190° F. and the second threshold temperature is approximately 190° F.

6. The cooling system of claim 1, wherein the first valve and the second valve are thermally-controlled valves.

7. The cooling system of claim 1, wherein the heat exchanger comprises any of a radiator, keel cooler, and skin cooler.

8. A system, comprising:

an engine, the engine having a cylinder head and a cylinder block;

a cooling system coupled to and separate from the engine, the cooling system including:

a heat exchanger;

a pump in fluid coupled to the heat exchanger;

an EGR cooler coupled to the pump; and a first valve between the EGR cooler and the pump and wherein when the first valve is in a first position, the first valve directs a coolant to the heat exchanger and when the first valve is in a second position, the heat exchanger is bypassed and coolant flows directly to the pump; and a second valve coupled to the cylinder head and the heat exchanger, wherein when the second valve is in a third position, the second valve directs a coolant to the heat exchanger and when the second valve is in a fourth position, the heat exchanger is bypassed and coolant flows directly to the pump, wherein when the first valve is in the first position, the first valve directs a coolant downstream of said second valve.

9. The system of claim 8, wherein the first position allows the maximum coolant flow rate throughout the cooling system and the second position enables the engine to warm up.

10. The system of claim 8, wherein the first valve is in the first position when the coolant has a temperature greater than a first threshold temperature and the second valve is in the third position when the coolant temperature is greater than a second threshold temperature, otherwise the first valve and the second valve remains in the second position and the fourth position respectively.

11. The system of claim 8, wherein the first valve and the second valve are any selected from a group comprising a normally-open valve and a normally-closed valve.

12. The system of claim 8, wherein the engine is utilized in a land application and the heat exchanger comprises a radiator.

13. A method for cooling an engine, comprising:

providing a heat exchanger, a pump, an EGR cooler, and a first valve to form a cooling loop; directing a coolant to the heat exchanger when the first valve is in a first position; and bypassing the heat exchanger and directing the coolant to the pump when the first valve is in a second position;

providing a second valve to direct the coolant to the heat exchanger when the second valve is in a third position, wherein the second valve bypasses the heat exchanger and directs the coolant to the pump when the second valve is in a fourth position; and directing the coolant from the first valve to a location downstream of said second valve when the first valve is in the first position.

14. The method of claim 13 wherein the engine comprises a cylinder head and a cylinder block.

15. The method of claim 14 further comprising splitting the coolant between the cylinder block and the EGR cooler.

16. The method of claim 13, wherein the second position promotes engine warm up.

17. The method of claim 13, wherein the when the first valve is in the first position, the temperature of the coolant at an inlet of the EGR Cooler is approximately equal to the temperature of the coolant at an outlet of the heat exchanger.

* * * * *